United States Patent [19]

Wolf

[11] Patent Number: 4,773,208

[45] Date of Patent: Sep. 27, 1988

[54] THREAD OR ROVING FRAGMENT REMOVAL FOR A SPINNING MACHINE

[75] Inventor: Horst Wolf, Albershausen, Fed. Rep. of Germany

[73] Assignee: Zinser Textilmaschinen GmbH, Ebersbach, Fed. Rep. of Germany

[21] Appl. No.: 858,937

[22] Filed: Apr. 30, 1986

[30] Foreign Application Priority Data

May 2, 1985 [DE] Fed. Rep. of Germany ..... 3515676

[51] Int. Cl.[4] ..... D01H 11/00

[52] U.S. Cl. ..... 57/305; 57/304

[58] Field of Search ..... 57/304, 305, 300–302

[56] References Cited

U.S. PATENT DOCUMENTS

| | | | |
|---|---|---|---|
| 2,819,579 | 1/1958 | Avera | 57/305 |
| 2,908,029 | 10/1959 | Furst | 57/305 X |
| 2,946,174 | 7/1960 | Bahnson | 57/304 |
| 2,976,556 | 3/1961 | Reiterer | 57/304 X |

FOREIGN PATENT DOCUMENTS

| | | |
|---|---|---|
| 182344 | 6/1955 | Austria . |
| 1604907 | 9/1949 | Fed. Rep. of Germany . |
| 938653 | 2/1956 | Fed. Rep. of Germany . |
| 2450627 | 9/1976 | Fed. Rep. of Germany . |
| 2643902 | 3/1977 | Fed. Rep. of Germany . |
| 3025064 | 1/1981 | Fed. Rep. of Germany . |
| 57-42930 | 3/1982 | Japan . |
| 315287 | 8/1956 | Switzerland . |
| 913673 | 12/1962 | United Kingdom . |

*Primary Examiner*—John Petrakes

*Attorney, Agent, or Firm*—Herbert Dubno

[57] ABSTRACT

A process for operation of an approximately horizontal suction duct used for removal of broken fragments of thread or roving from a spinning machine and a suction apparatus for performing that process. In the process of my invention the suction capacity of the suction duct is made adjustable for joint adjustment of the suction at all of the suction intakes connected to it. Thus to reduce energy consumption this suction capacity can be set to a considerably lower value during normal operation than during doffing or batch changing where it is desirable to use the maximum rated suction capacity. The adjusting means for changing the suction capacity of the suction duct comprises advantageously a throttling means such as an automatically controllable plate mounted downstream from the suction intakes of the suction duct or a selector switch for providing different voltages to the winding terminals of an electric motor of an air blower mechanism to directly change the suction capacity.

23 Claims, 2 Drawing Sheets

THREAD OR ROVING FRAGMENT REMOVAL FOR A SPINNING MACHINE

CROSS REFERENCE TO RELATED APPLICATIONS

This application is related to the commonly owned copending applications Ser. No. 762,156 filed August 2, 1985 (now U.S. Pat. No. 4,612,761 issued Sept. 23, 1986), Ser. No. 812,253 filed Dec. 23, 1985 (now U.S. Pat. No. 4,612,760 issued Sept. 23, 1986), Ser. No. 819,541 filed Jan. 16, 1986, Ser. No. 828,838 filed Feb. 12, 1986 and Ser. No. 834,627 filed Feb. 27, 1986.

FIELD OF THE INVENTION

My present invention relates to a spinning machine, and more particularly to a method of operating a suction duct system for removal of broken pieces of thread, yarn and roving or fragments otherwise formed during operation of a spinning machine from the spinning stations. The invention also relates to an apparatus for this purpose.

BACKGROUND OF THE INVENTION

A horizontal suction duct can be provided for removing broken pieces of yarn and/or roving pieces, hereinafter referred to generally as fiber fragments, from a spinning machine, preferably a spinning machine used to manufacture yarn or threads, the spinning machine being a ring or other spinning machine or a fly frame or a drafting frame forming a part thereof. Each suction duct for the spinning machine has intakes at each of a plurality of working positions of the spinning machine, i.e. the positions found on one longitudinal side of the spinning machine.

Many known spinning machines have a broken thread or roving suction apparatus. These suction apparatuses and improvements thereon are described in a number of patents, for example U.S. Pat. No. 2,819,579, U.S. Pat. No. 2,946,174, Swiss Patent No. 315287, German Patent No. 938,653, German Open Patent Application No. 30 25 064, Austrian Patent No. 182344, British Patent No. 913,673, German Printed Patent Application No. 24 50 627, and German Open Patent Application No. 26 43 902.

In general, the suction apparatus acts to pull away and remove broken threads or roving from the drafting frame, spinning rotors, or other working components supplied with sliver, pieces of thread or the like.

Such apparatus can also be used in spinning machines which make thread, such as ring spinning machines, bell spinning machines, open ended spinning machines and the like.

Large scale spinning machines used in factories having a plurality of working positions also can have a suction apparatus with an intake nozzle or opening at each working position.

In these machines the thread or yarn is warped or drawn, e.g. in a drafting frame, twisted, wound up on bobbins as sliver, stored in cans, or sent to other spinning or twisting machines for further processing. By roving I generally mean pieces of thread, sliver, or the like which usually have a slight twist, although roving in many cases is free from twist.

All of these machines can be described as yarn-handling machines with individual working positions for each of the multiplicity of yarns handled.

The number of working positions of a spinning machine thus usually corresponds to the number of stations where yarn, thread or the like is supplied.

The stations where yarn are supplied are in the case of a ring spinning machine, its spindles so that the number of spindles corresponds to the number of working positions in this machine.

In an open-ended spinning machine the number of spinning rotors corresponds to the number of working position and in a flyer frame each working positions is a respective flyer.

It is also conceivable that one supply station can be associated with several working positions, which are provided with suction intakes of the suction duct, when several threads run from a common supply station. In the case of broken thread or roving at the concerned working position the fiber, thread or like fragments are removed by the suction apparatus.

In many cases, particularly in spinning machines used to manufacture yarn, both longitudinal sides of the spinning machine have a row of working positions. There are also spinning machines, including machines for the manufacture of yarn, which have working positions on only one longitudinal side of the machine or several rows of working positions, for example a flyer frame.

Every row of working positions is usually associated with a single horizontal suction duct, which can have suction intakes in its peripheral walls associated with this row of working positions.

Alternatively these suction intakes can be provided in suction tubes or nozzles connected to the suction duct which is the more commonly used design. Commonly a single suction opening is provided per working position but in many cases at least two suction openings are provided per working position, for example when two rovings running adjacent each other are twisted together to form a common thread.

In very long spinning machines each row of working positions is associated with at least two horizontal suction ducts. However one horizontal suction duct per row of working positions is the standard situation.

A single suction apparatus can have a single suction duct or a plurality of suction ducts. Each suction apparatus has an air blower mechanism or an axial ventilator, a radial ventilator, or the like and further at least one filter device like a fiber filter or the like which acts to remove fiber pieces, strands or the like carried along with the flowing air.

One such suction apparatus can be directly mounted in a spinning machine or a single suction blower can be associated with a plurality of machines or conversely each machine can have two or more suction blowers. A single large broken thread and/or roving suction apparatus can be provided for a plurality of spinning machines and can have a central air blower mechanism to which the horizontal suction ducts associated with it are connected by one collector duct or a system of collector ducts.

The energy consumption of a broken thread and/or roving suction apparatus is dictated by the total quantity of air extracted by it from the working positions per unit time.

The suction capacity of a suction duct must be dimensioned for the case in which broken threads alone, broken roving alone, or some mixture of broken roving and threads is present at each station especially immediately after a batch change or after doffing. Of course after a batch change broken threads or rovings are found at all working positions, and fresh thread or roving must be connected at all the working positions. This can be effected by a working column member or by a threading carriage and lasts a short time, for example 10 to 30 minutes.

For this reason the usual suction apparatus has its suction capacity dimensioned so that in the extreme case of startup the fiber pieces, threads or the like from the draw frame, spinning rotors, or the like can be simultaneously removed from all affected working positions, e.g. upon doffing. This suction capacity has hitherto been fixed or constant during the operation of the spinning machine and also during doffing.

However it is also known to reduce the total air flow per unit time of the flowing air by throttling individual intake nozzles associated with selected working positions of a spinning machine and to open the individual tubes only when a thread break occurs at the associated working position position (U.S. Pat. No. 2,819,579).

In view of the normally very large number of working positions and thus suction tubes the cost of a system with individual nozzle valves is very high, since every working position requires a thread break sensor. Also the continuous suction of air from all working positions in a spinning machine is desirable, since then in in all case broken threads or broken roving, sliver, or the like are immediately removed. Also lint blown off in such a spinning machine is continuously removed. Thus contamination of the spinning machine by fuzz or dirt is considerably reduced.

For many years the broken thread or roving suction apparatus with constant suction capacity has been used. Additionally suction apparatuses can also be provided to transport fragments of broken thread, roving or sliver collected from various working positions in a central collection chamber to a processing room for recycling as taught in U.S. Pat. No. 2,946,174. In both cases the required air feed capacity is however quite high and causes a considerable energy expenditure.

Other means for directly sensing the flow rate of broken fibers in a suction duct have been taught for general control of suction duct operation (Swiss Patent No. 315,287 and Austrian Patent No. 182,344). But these devices involve a time delay, fairly complicated electronics and additional expense.

OBJECTS OF THE INVENTION

It is an object of my invention to provide an improved method of operating a broken thread and roving removal suction duct for a spinning machine which avoids drawbacks of earlier systems.

Another object of my invention is to provide an improved fragment removal apparatus for a yarn-handling machine, It is also an object of my invention to provide an improved process and apparatus for a broken thread and roving removal in a spinning machine, in which a considerable reduction in the energy consumption by the broken thread and/or roving suction apparatus during operation of the spinning machine is achieved without costly additional mechanism to open and close the individual suction intakes associated with the suction duct or ducts.

SUMMARY OF THE INVENTION

These objects and others which will become more apparent hereinafter are attained in a method of operating a broken thread and roving removal suction duct for a suction apparatus of a yarn-handling machine such as a spinning machine, preferably a spinning machine used to manufacture yarn or a fly frame, the suction duct having intakes associated with a plurality of working positions of the spinning machine, all of the working positions located on one longitudinal side of the spinning machine.

The suction apparatus which acts to remove broken thread and roving can comprise at least one approximately horizontal suction duct which acts to draw air from the plurality of working positions in the spinning machine.

According to my invention the suction capacity of the suction duct is set lower in normal operation than a maximum possible value of the suction capacity and the suction capacity is set higher than in the normal operation when the fiber fragments are being received by the suction duct at the working positions as a result of batch changing or doffing. In an apparatus according to my invention to perform this process the adjusting means can set a higher value of the suction capacity of said suction duct for doffing in the working positions associated with the suction apparatus and can set a lower value of the suction capacity for normal operation of the spinning machine.

In the process according to my invention the suction intakes found at the working positions of the concerned spinning machines are continuously unalterably open when the suction capacity of the suction duct is adjusted. It is of course also possible to provide the suction intakes with throttling means for adjustably throttling them. The suction intakes of the suction duct can be open-ended suction tubes connected to the suction duct or simply holes in the wall of the suction duct.

The suction capacity of the suction duct can be greatly reduced in the normal operation of the spinning machine, for example to 30 to 80% of the maximum value required for doffing. Hitherto one had to maintain the maximum suction capacity used during doffing during normal operation of the spinning machine.

My invention provides, by contrast, a considerable reduction of the suction capacity of the concerned suction duct during normal operation for a correspondingly considerable energy saving. By normal operation we mean operation in which the machine operates normally and only an occasional broken thread or roving occurs.

In normal operation the broken thread or roving problem can be quickly overcome by operator action or by an automatic rethreading mechanism, so that the percentage of working positions in which a broken thread or roving is present is extraordinarily small.

Surprisingly the suction capacity required following isolated thread breaking or roving breaking during normal operation for a reliable drawing off of the broken thread or roving is considerably smaller than that required at the beginning of doffing when broken threads or roving are to be found at all working positions in the spinning machine.

By suction capacity I mean the energy required to withdraw air from the concerned suction duct. (This suction capacity can be more precisely defined as the product of the volume flow of the air flowing out of the suction duct and a pressure difference acting to cause the flow).

The adjustment of the suction capacity of the suction duct can be provided in a variety of different ways.

Advantageously the adjustment can be provided in a single step, namely from a maximum suction capacity, such as is required in doffing to a smaller suction capacity for normal operation. As mentioned already this latter suction capacity can advantageously be approximately 30 to 80% of the maximum value.

It is however also possible and in many cases suitable to reduce the suction capacity continuously or in a plurality of steps. This allows still greater energy savings both during doffing and normal operation. As the doffing progresses the suction capacity of the suction duct can be continuously reduced or reduced in a series of steps.

In normal operation the ability to reduce continuously or stepwise the suction capacity, enables the required lowered suction capacity to be set differently during normal operating conditions. Of course the suction capacity can be reduced accordingly with every reduction of speed with which the threads are supplied to the working position adjacent the concerned suction outlet of the drafting frame or the like and according to the fineness of these threads. One can fit the suction capacity provided for normal operation in each batch change to that particular batch when the suction capacity is reduceable in several steps or continuously. Correspondingly one can provide the required suction capacity at the beginning of doffing in different size values according to differing requirements.

The adjustment of the suction capacity can occur by an operator's action, semiautomatically or completely automatically. Usually manual adjustment is preferable. In case the spinning machine has detecting means which detects when spinning is activated or terminated, this detection means can automatically raise the suction capacity at the beginning of doffing.

It can also provide a sensing mechanism associated with the suction duct or the suction apparatus, which detects when many broken threads or roving fragments are drawn off, as occurs in doffing, to automatically raise the suction capacity.

The sensing mechanism can also act to adjust the suction capacity after it has been raised automatically downward to a lower value in steps or continuously for normal operation. One such sensing mechanism can sense a pressure difference in the suction duct, which depends on the quantity per unit time of the broken fiber, thread, roving and the like pulled off.

Alternatively the sensing mechanism can be an optical mechanism which senses optically the fibers or threads sucked away by passage through one of several suction ducts. This optical sensor can be for example a light source and a light detector irradiated by the light source. The light intensity at the light detector is reduced when the flow rate of fibers, threads, lint, or the like drawn through the suction duct is increased, since there are more opaque particles between the light source and detector.

It is also possible to provide a programmable switching mechanism which switches on at the beginning of doffing, then first sets the required high suction capacity required for the doffing and then reduces this suction capacity according to a predetermined program in two steps, in several steps or continuously until the suction capacity for normal operation is reached.

Various means for adjusting the suction capacity can be used. In many cases the adjustment can be handled by an air throttling means, such as a throttling valve or the like. Additionally or instead of such throttling means the air flow rate for the air drawn by the suction apparatus from the suction duct can be adjusted. This adjustment can occur again in different ways. Usually it is sufficient to adjust the rotation speed of the fan or impeller of the ventilator, blower or the like. When the impeller has adjustable blades one can adjust the angle of attack of the blades to adjust the air flow rate.

The adjustment of the rotation speed of the impeller of the air blower mechanism can for example be provided by a changeable-pole electric motor or an electric motor otherwise adjustable as to its rotation speed. It is particularly advantageous when the electric drive motor of the air blower mechanism is provided with two winding terminals which are designed for two different voltages and the rotational speeds of the air blower mechanism are selectable by applying the lower of the voltages to the one or the other of the winding terminals. Thus for example one has a nominal voltage of 440 V for one terminal and 380 V for the other terminal of the motor winding. When 380 V is applied to the 380 V terminal, then the normal operating speed results, but when 380 V is applied to the 440 V terminal the motor runs with reduced operating speed.

That considerable energy savings are possible by adjustment of the rotation speed of the impeller of the air blower mechanism should be clear from the following numerical example. When a radial blower is used as the air blower mechanism, the air flow rate increases with the third power of the rotation speed. A reduction of the rotation speed of the impeller to around 85% of nominal rotation speed results in a reduction of the current flow in the drive motor to about 72% of the nominal current, since the current of an asynchronous motor under load increases with the square of its rotation speed. The air flow thus drops to 60% of the air flow at the nominal rotation speed of the impeller.

When the rotation speed of the drive motor does not strongly fluctuate in operation an increased energy saving results by reduction of the air flow rate required by the impeller driven by this motor. This reduction of the air flow rate can be cause by throttling of the air flow. In every case the applied electric power to the drive motor of the air blower mechanism and thus the energy consumption is smaller according to the degree to which the suction capacity of the suction duct connected to this blower mechanism is reduced.

Thus the invention permits considerable savings in energy consumption during operation of the suction duct. This energy saving is further increased by the reduction of the flow speed of the air in the air conduit since flow losses are reduced.

In order to reduce the suction capacity of the suction duct still further, the suction intakes in the individual working positions, upon changing of the rovings running from the draw frame, are changed with them. This can involve a to and fro motion of the suction duct or by changing of flexible suction tubes provided with the suction outlets as is taught in German Patent Document DE-Gbm No. 1 604 907.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
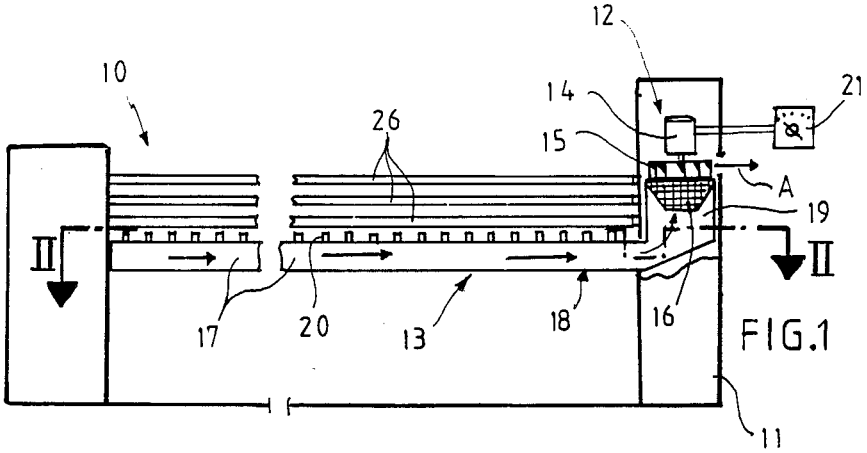
FIG. 1 is a cut away schematic cross sectional view of a spinning machine showing a portion of an apparatus having a broken thread and roving removal suction duct according to my invention under the rollers of a single drawing frame.

A suction apparatus 13 has a rotary blower 12 mounted in a housing 11 positioned at one longitudinal end of a spinning machine 10 used for the manufacture of yarn. The air blower mechanism, in this case a radial blower 12, has an electric drive motor 14 and a rotary impeller 15.

The rotary impeller 15 blows the air it pulls in from the duct system 18 through a filter device 16 in the direction of the arrow A into the exterior machine room or this air can also be collected and conducted to other locations.

Figure 2:
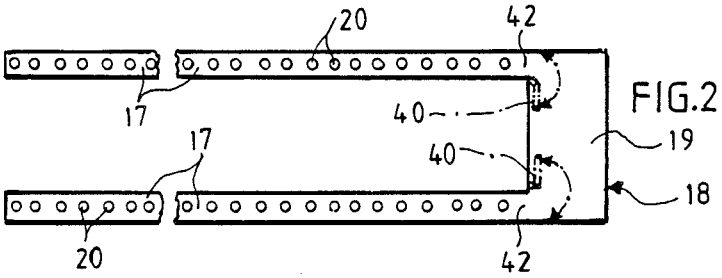
FIG. 2 is a schematic cross sectional view of the apparatus of FIG. 1 taken along the section line II—II in the direction of the arrows.

The filter 16 is located in a short vertical guide shaft 19 of the apparatus, to which a horizontal suction duct 17 is connected on each longitudinal side of the spinning machine 17 as seen in FIG. 2. Both these suction ducts 17 extend along the drafting frame on the particular side on which they are located.

In FIG. 1 only the lower drafting frame rollers 26 are shown on one of the longitudinal sides of the spinning machine 10.

At every spinning position (working position) of the spinning machine 10 a fixed suction tube 20 open at the top branches from the suction duct 17, through which air can be pulled into the concerned suction duct 17.

The individual suction tubes 20 are located, as is standard, in the small clearance space under the threads drawn by the drafting frame during operation from the drafting frame. The fragments of thread are immediately twisted to yarn in the case of a spinning machine spinning yarn. In the case of flyer frame the fiber fragments running from the drafting frame are fed as sliver to a flyer, which winds them up on the roving bobbins.

When the suction apparatus is found in an open ended spinning machine (OE-spinning machine) then the suction intakes are positioned so that always, when fiber fragments from the associated spinning rotors do not reach the appropriate bobbins, these fiber fragments are sucked into the suction duct by the suction apparatus.

The suction capacity of both suction ducts 17 extending along the draw frame of the concerned machine longitudinal side (FIG. 2) is controlled by the rotation speed of the electric drive motor 14, on whose shaft the impeller 15 of the rotary blower 12 is mounted, and is adjustable to either of two different values by a selector switch 21.

The motor 14 can have a maximum rotational speed for which the motor 14 is rated and produces a standard suction capacity and also at a predetermined considerably lower rotation speed. When dpffing on one or both longitudinal sides of the spinning machine is required, for a batch change, the drive motor 14 is switched to its maximum rotation speed and thus both suction ducts 17 operate at their maximum suction capacity.

When doffing substantially or completely is finished and the twisting of thread, roving or sliver to yarn begins, the selector switch 21 is thrown by an operator into a position causing the drive motor 14 to run with reduced rotation speed. In this switch position the motor 14 remains at a reduced speed during normal operation of the spinning machine in which only isolated single yarn breaking events occur which can be corrected by an operator or by an automatic threading mechanism. When fresh sliver or thread is required in all working positions or at least on one longitudinal side of the spinning machine 10, the selector switch 21 is again reversed to provide a maximum rotational speed for the drive motor 14.

When desired each longitudinal side of a spinning machine can be provided with its own separate suction apparatus of which each one is provided with its own feed mechanism, its own suction duct, like 17, and its own filter device.

To be able to reduce the power consumption of the motor 14, the suction apparatus 12 can be designed so that it can sometimes produce the required high suction capacity for doffing selectively on only one longitudinal side of the machine.

The horizontal suction duct 17 found on the other longitudinal side of the machine can then be throttled by a choke or throttle mechanism—in this case by a choke and/or throttle valve 40 (FIG. 2), when the other side of the machine is turned on. For this purpose both downstream ends of the suction ducts 17 and of course their duct mouths 42 are each associated with such a throttle valve 40. Independently of each other the throttle valves 40 can be opened to their maximum open position in which the duct mouth 42 is open widest or they can be adjusted so that the mouth 42 is strongly throttled. This adjustment can be performed by a servo adjusting motor or simply manually by an operator.

The valves 40 can be adjusted in a stepwise fashion or continuously, can be fixed in position by a locating device and can be held fixed by a locking mechanism or some other device.

Upon switching of the motor 14 to its maximum rotation speed by the selector switch 21, or automatically the valve 40 can be adjusted automatically or manually into a position choking or throttling the mouth 42 of the associated suction duct 17 on the side of the machine not turned on, that is, the side opposite that side of the machine is turned on.

Here the suction capacity of the operating suction duct 17 is raised because from the other suction duct 17 little or no air is pulled through because of the downstream throttling by the valve 40 or by a complete shut off, so that the entire suction capacity of the feed mechanism is divided nonuniformly between both ducts 17 or is only for one suction duct 17. The motor 14 thus requires a smaller nominal operating power consumption. After and shortly before the end of doffing one can reduce the operating speed of the motor 14 again to the standard operating conditions and the concerned valve 40 can be opened to its maximum open position, so that now both valves 40 are fully open and the suction capacities of both suction ducts 17 again are equally large. A nonadjustable motor 14 can be used and even the selector switch 21 can be omitted. In the simplest case the adjustment of the suction capacity of both suction ducts 17 occurs only by valves 40. By closing a valve 40 into a choked position or into its throttled position the suction capacity of the suction duct 17 associated with this valve 40 is diminished and thus automatically the suction capacity of the other duct 17 is raised because of the constant capacity of the air blower mechanism 12.

Figure 3:
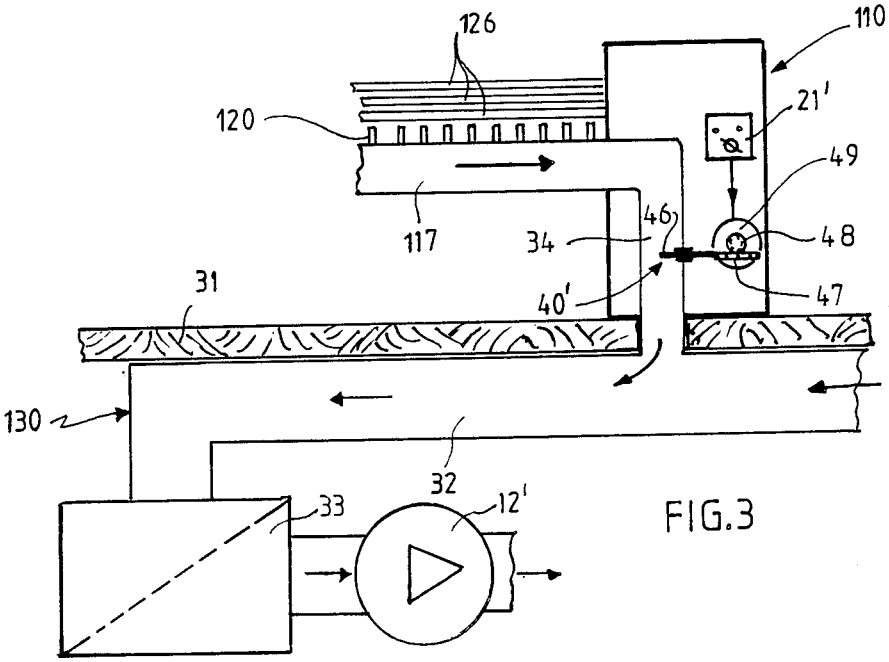
FIG. 3 is a partially cut away schematic cross sectional view of an alternative embodiment of an apparatus for operating a broken thread and roving removal suction duct according to my invention.

In FIG. 3 another embodiment of the suction apparatus 130 of my invention is shown which can be connected to a plurality of spinning machines of which one spinning machine 110 is shown. This suction apparatus 130 has a plurality of collector ducts 32 or a single collector duct 32 mounted under the floor 31 of the machine room. The collector duct or ducts 32 are connected to a correspondingly larger suction ventilator or rotary blower 12' by a thread piece filter 33. This thread piece filter 33 is a filter device and can remove dust and residual fibers as well as thread pieces. The horizontal suction duct 117 of the longitudinal side of the machine shown in the drawing is connected to the collector duct 32 by a vertical connector duct 34. To this collector duct 32 a plurality of such suction ducts 117 in other spinning machines and/or on the other side of the illustrated spinning machine 110 can be connected.

The capacity of the suction ventilator or rotary blower 12' need not be designed in this case so that all the connected horizontal suction ducts 117 can be operated simultaneously with the high suction capacity required for doffing, since that case never occurs or certainly must be avoided. Normally the capacity of the suction ventilator 12' in this case is designed only for the case of one or two longitudinal sides of the spinning machine associated with the suction apparatus being turned on and all other longitudinal sides of the machine or all other spinning machines not turned on at the same time.

The nominal capacity of the suction ventilator 12' can then advantageously be of such a size that it is designed to provide normal suction operation and also the increased suction capacity required for doffing for only one or a few horizontal suction ducts 117.

In this embodiment the suction capacity of the suction duct 117 is adjusted by a throttle device 40'. The suction ventilator 12' can advantageously be operated with a safe constant rotational speed or with an adjustable rotational speed to fit its capacity.

When a suction duct 117 is positioned on the other longitudinal side of this spinning machine 110, it can be connected to the collector duct 32 or one of the collector ducts 32 available and can likewise be provided with its own throttling valve 40'. One can adjust both suction ducts 117 of this machine independently of each other in their suction operation. When in contrast the adjustment of the suction capacities of two or more suction ducts 117 of the same machine 110 need to be continuously synchronized, I can also provide upstream of these ducts 117 a throttle mechanism 40' in a common connector pipe 34 which opens into the collector duct 32. This is also true in the case where the suction ducts of at least one other spinning machine are connected to the suction ventilator 12'.

The throttle mechanism or valve 40' has a linearly horizontal plate 46 to which a toothed rack 47 is attached. The toothed rack 47 engages a pinion 48 of an adjusting motor 49. The adjusting motor 49 controllable by a selector switch 21' can be driven either clockwise or counter clockwise and thus slides the plate 46 into the completely open position or into one or several throttling positions. Of course the plate 46 is in an open position, preferably completely open, during doffing, and at the end of or near the end of the doffing process can be moved by the adjusting motor 49 into at least one throttling position. After the end of the doffing a comparatively strongly throttled position of the plate 46 is set by which the suction capacity of the suction duct 17 is reduced to a value which is provided for the standard operation of the working position of this side of the spinning machine. Since the air blower mechanism or rotary blower 12' is designed and operated considerably weaker than it would be if it was necessary to provide suction capacity for doffing all of the machines simultaneously, a considerable energy saving can be attained. Also the suction capacity of the suction ventilator 12' is lowered after doffing as soon as the throttling mechanism 40' associated with the considered suction duct 17 is set to its normal from its heavily throttled operating position.

When the adjustment of the suction capacity of a suction duct, like 17, occurs by throttling means, it can occur in the suction ducts alone, for example at the downstream end of the suction ducts, or in an associated suction conduit connected to it (as for example in the connector pipe 34. Alternatively the suction capacity of a plurality of suction ducts, preferably all the suction ducts, of a spinning machine are jointly adjustable by the same throttling mehcanism.

Figure 4:
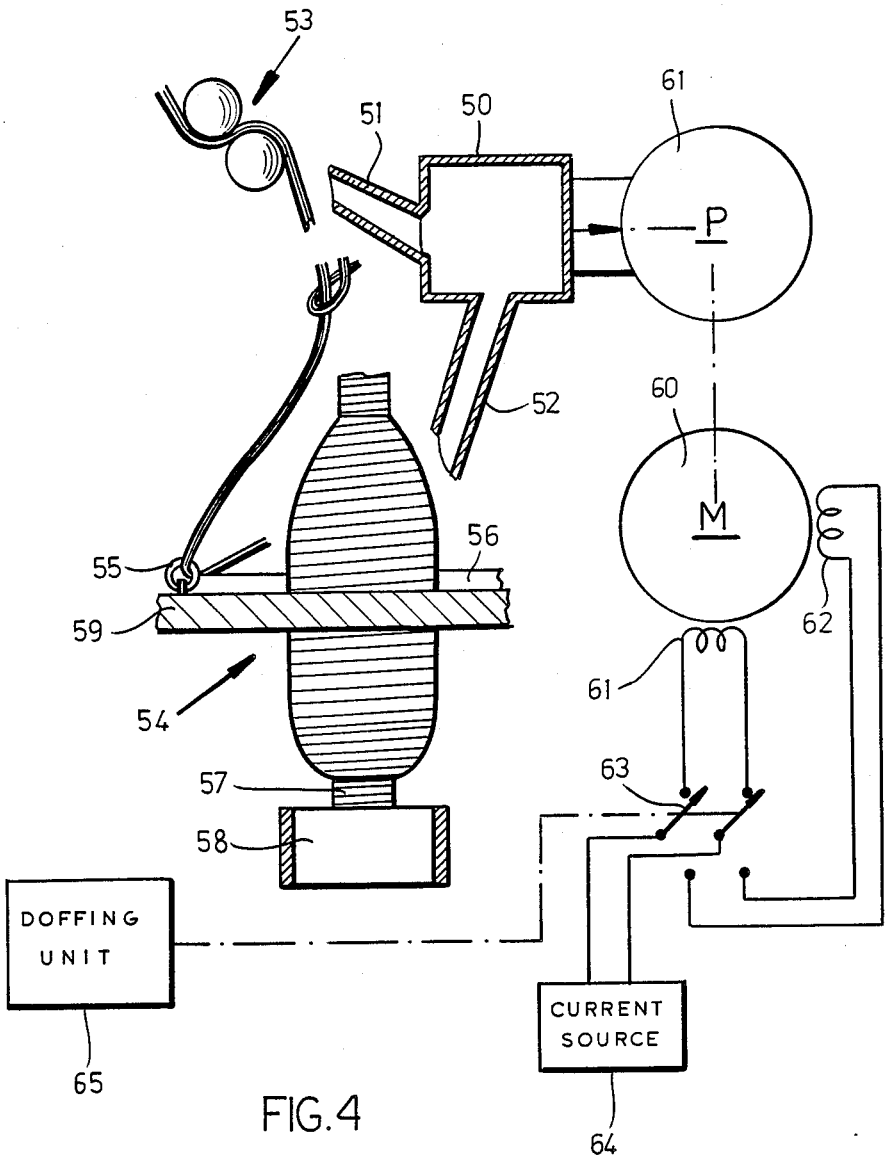
FIG. 4 is another diagram illustrating the invention.

As can be seen in FIG. 4 the duct 50 can have its suction intakes 51, 52 juxtaposed at each station with the I0 drawing frame 53 (only partly shown) and with the spinning and twisting frame 54, here a ring-type twisting arrangement with a traveller 55 orbiting a traveller rail or ring 56, a spindle 57 driven by a wheel 58 and a ring bank 59, all shown most diagrammatically. Here the motor 60, driving the suction blower 61' connected to the duct 50, can have two windings 61, 62 as previously described while the switch 63 can selectively connect the current source 64 of a given voltage to either of the two windings under the control of the doffing unit 65. Hence during doffing the source 64 is connected to the winding 61 for driving the motor at full speed while at the conclusion of doffing the winding 62 is connected to the source 64. Winding 62 is rated for higher voltage and thus the motor is driven at a lower speed.

I claim:

1. A method of operating of a suction apparatus for removing fiber fragments in a yarn-processing machine having a multiplicity of individual working positions, and wherein the apparatus has a generally horizontal suction duct with a respective suction intake at each working position, air being suctioned simultaneously at each working position through the respective intakes, said method comprising the steps of:

(a) applying to said duct, suction at a suction capacity set lower in normal operation than a maximum possible value of said suction capacity; and (b) increasing said suction capacity to a level greater than that in said normal operation when fiber fragments are received by said suction duct at said working positions on account of breakages of fiber strands at a multiplicity of said positions.

2. The method defined in claim 1 wherein said suction capacity of said suction duct is reduced from said maximum possible value in a plurality of steps.

3. The method defined in claim 1 wherein said suction capacity of said suction duct is adjusted continuously in step (b).

4. The method defined in claim 1 wherein following the use of a high value of said suction capacity of said suction duct said suction capacity is automatically reduced under programmed control to a lower value provided for said normal operation.

5. The method defined in claim 1 wherein the change of said suction capacity of said suction duct is effected automatically depending on the amount of fiber per unit time being removed by said suction duct or from the concerned one of said spinning machines.

6. The method defined in claim 5 wherein the value of said suction capacity of said suction duct in step (a) is approximately from 30 to 80% of the value of said suction capacity in step (b).

7. The method defined in claim 6 wherein the suction capacity of said suction duct is changed by adjustment of the air flow rate of an air blower mechanism acting to draw air from said suction duct.

8. The method defined in claim 6 wherein the suction capacity of said suction duct is changed by throttling of said suction capacity.

9. The method defined in claim 6 wherein the suction capacity of said suction duct is changed by air throttling means mounted downstream of said suction duct.

10. The method defined in claim 6 wherein the suction capacity of said suction duct is changed by throttling at least one other suction duct connected to an air blower mechanism connected to said suction duct.

11. A broken thread and roving suction apparatus for removing fibers such as broken fragments of thread and roving from a spinning machine, said suction apparatus comprising:

at least one approximately horizontal suction duct located to draw air simultaneously from each of a plurality of working positions in said spinning machine; and adjusting means for adjusting said suction capacity of said suction duct, said adjusting means being provided with means for setting a higher value of said suction capacity of said suction duct for doffing at said working positions and setting a lower value of said suction capacity for normal operation of said spinning machine between doffings.

12. The apparatus defined in claim 11 wherein said suction apparatus includes an air blower mechanism acting to draw away air from said suction duct at an air flow rate which is adjustable to adjust the suction capacity of said suction duct.

13. The apparatus defined in claim 12 wherein said means for setting inclues means for adjusting the rotational speed of said air blower mechanism.

14. The apparatus defined in claim 13 wherein the said air blower mechanism has an electric drive motor provided with two winding terminals energizable by two different voltages for selecting said rotational speed of said air blower mechanism by applying the lower of said voltages to the one or the other of said winding terminals.

15. The apparatus defined in claim 11 wherein said suction apparatus has adjustable air throttling means acting to adjust said suction capacity of the ones of said suction ducts associated therewith.

16. The apparatus defined in claim 11 wherein said suction apparatus is associated with a plurality of said suction ducts.

17. A broken thread and/or roving suction apparatus for removing broken thread, lint, slivers, roving and the like from a plurality of working positions in a spinning machine which comprises:

at least one substantially horizontal suction duct;

a plurality of suction intakes for receiving said broken thread, lint, slivers, roving and the like, each positioned adjacent one of said working positions with said intakes drawing air simultaneously from the respective working positions;

an air blower mechanism connected to the downstream end of said suction duct including an electric motor driving an air blower drawing air from said suction duct; and an adjusting means for adjusting the suction capacity of said suction duct to a maximum possible value of said suction capacity for doffing or batch changing and to a lower value or values of said suction capacity for normal operation.

18. A suction apparatus according to claim 17 wherein said adjusting means comprises an air throttling means mounted downstream of said working positions in said suction duct comprising an electrically driven damper.

19. A suction apparatus according to claim 17 wherein the speed of said electric motor of said air blower mechanism is adjustable by adjusting the applied operating voltage to at least two values of said voltage in order to provide at least two operating speeds for said air blower mechanism and hence two suction capacities for said suction apparatus.

20. The method defined in claim 1 wherein the suction intakes are selected from open-ended suction tubes connected to the suction duct or are holes in a wall of the suction duct.

21. The method defined in claim 1 wherein there are at least two suction intakes for each working position.

22. The apparatus defined in claim 11 wherein the suction intakes are selected from open-ended suction tubes connected to the suction duct or are holes in a wall of the suction duct.

23. The apparatus defined in claim 11 wherein there are at least two suction intakes for each working position.

* * * * *